US010107089B2

(12) United States Patent
Greening et al.

(10) Patent No.: US 10,107,089 B2
(45) Date of Patent: Oct. 23, 2018

(54) TOP DRIVE MOVEMENT MEASUREMENTS SYSTEM AND METHOD

(71) Applicant: Nabors Drilling Technologies USA, Inc., Houston, TX (US)

(72) Inventors: Douglas Greening, Calgary (CA); Marinel Mihai, Calgary (CA); Brian Dewald, Calgary (CA); Piew Soe Saw, Calgary (CA)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 115 days.

(21) Appl. No.: 14/140,031

(22) Filed: Dec. 24, 2013

(65) Prior Publication Data

US 2015/0176390 A1 Jun. 25, 2015

(51) Int. Cl.

| | |
|---|---|
| ***E21B 47/00*** | (2012.01) |
| ***E21B 44/00*** | (2006.01) |
| ***E21B 3/02*** | (2006.01) |

(52) U.S. Cl.

CPC ..... *E21B 44/00* (2013.01); *E21B 3/02* (2013.01); *E21B 47/0006* (2013.01)

(58) Field of Classification Search

CPC ..... E21B 3/02; E21B 44/00; E21B 47/0006

USPC ..... 73/152.49

See application file for complete search history.

(56) References Cited

U.S. PATENT DOCUMENTS

| | | | | |
|---|---|---|---|---|
| 4,479,564 | A * | 10/1984 | Tanguy | E21B 44/00 175/45 |
| 4,715,451 | A | 12/1987 | Bseisu et al. | |
| 5,272,925 | A * | 12/1993 | Henneuse | E21B 3/02 73/152.49 |
| 5,358,059 | A * | 10/1994 | Ho | E21B 44/00 175/45 |
| 6,315,062 | B1 * | 11/2001 | Alft | E21B 7/046 166/255.2 |
| 2005/0071120 | A1 * | 3/2005 | Hutchinson | E21B 47/04 702/150 |
| 2005/0109097 | A1 * | 5/2005 | Bogath | E21B 17/16 73/152.49 |

(Continued)

FOREIGN PATENT DOCUMENTS

WO 2013/142950 10/2013

OTHER PUBLICATIONS

Christoforou et al, Fully coupled vibrations of actively controlled drillstrings, 2003, Journal of Sound and Vibration.*

(Continued)

*Primary Examiner* — Harshad R Patel
*Assistant Examiner* — David L Singer
(74) *Attorney, Agent, or Firm* — Enrique Abrarca; Abel Law Group, LLP

(57) ABSTRACT

Top drive movement measurement system having a sensor module configured to be disposed about and couple to a component of a top drive system, a first plurality of sensors of the sensor module, wherein the first plurality of sensors is configured to detect lateral movement of the component of the top drive system, and a second plurality of sensors of the sensor module, wherein the second plurality of sensors is configured to detect one or more compression or tension forces in the component of the top drive system.

11 Claims, 7 Drawing Sheets

(56) References Cited

U.S. PATENT DOCUMENTS

2006/0065395 A1* 3/2006 Snell ..... E21B 47/01 166/255.2
2008/0125876 A1* 5/2008 Boutwell ..... E21B 19/165 700/21
2008/0202810 A1* 8/2008 Gomez ..... E21B 47/011 175/40
2009/0151934 A1* 6/2009 Heidecke ..... E21B 3/02 166/250.01
2010/0065336 A1* 3/2010 Wells ..... E21B 19/16 175/220
2010/0214121 A1* 8/2010 Puro ..... E21B 47/12 340/854.6
2011/0016964 A1 1/2011 Strom
2011/0024188 A1* 2/2011 Wassell ..... G01V 11/002 175/40
2011/0153296 A1* 6/2011 Sadlier ..... E21B 44/00 703/7
2011/0186353 A1* 8/2011 Turner ..... G05B 13/048 175/40
2012/0080227 A1 4/2012 Cardellini et al.
2012/0160517 A1* 6/2012 Bouligny ..... E21B 3/02 166/380
2013/0056275 A1 3/2013 Neidhardt et al.
2015/0021016 A1* 1/2015 Deng ..... E21B 44/00 166/250.01

OTHER PUBLICATIONS

Leine et al, Stick-slip Whirl Interaction in Drillstring Dynamics, 2002, Journal of Vibration and Acoustics Apr. 2002, vol. 124, 209-220.*
Jansen et al, Active Damping of Torsional Drillstring Vibrations With a Hydraulic Top Drive, 1995, SPE Drilling & Completion, Dec. 1995.*
Nicholson, An Integrated Approach to Drilling Dynamics Planning, Identification, and Control, 1994 IADC/SPE Drilling Conference held in DAllas , Texas, Feb. 15-18, 1994.*
PCT ISR and Written Opinion for PCT/US14/065772 dated Jul. 23, 2015.

* cited by examiner

TOP DRIVE MOVEMENT MEASUREMENTS SYSTEM AND METHOD

BACKGROUND

Embodiments of the present disclosure relate generally to the field of drilling and processing of wells. More particularly, present embodiments relate to a system and method for measuring movement of a top drive system.

Top drives are typically utilized in well drilling and maintenance operations, such as operations related to oil and gas exploration. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a top drive system may rotate the drill string to facilitate drilling.

Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling." Casing may be defined as pipe or tubular that is placed in a well to prevent the well from caving in, to contain fluids, and to assist with efficient extraction of product. When the casing is run into the well, the casing may be gripped and rotated by a top drive.

Drill string and casing may generally be referred to as pipe or tubular. It is now recognized that, when the drill string or casing is run into the well, the top drive and the corresponding pipe may be susceptible to lateral movement (e.g., swirl movement). Such movement may cause undesired stresses on any of various portions of a drilling or casing system. For example, undesired levels of stress may be placed on the drill string, the casing, the top drive, and/or other components of the drilling rig.

BRIEF DESCRIPTION

In accordance with one aspect of the disclosure, a system includes a top drive movement measurement system having a sensor module configured to be disposed about and couple to a component of a top drive system, a first plurality of sensors of the sensor module, wherein the first plurality of sensors is configured to detect lateral movement of the component of the top drive system, and a second plurality of sensors of the sensor module, wherein the second plurality of sensors is configured to detect one or more compression or tension forces in the component of the top drive system.

In another embodiment, a method includes detecting a first parameter indicative of lateral movement of a top drive system with respect to a rotational axis of the top drive system with a first plurality of sensors, detecting a second parameter indicative of lateral movement of the top drive system with respect to the rotational axis of the top drive system with a second plurality of sensors, wherein the first parameter is different from the second parameter, transmitting the first parameter and the second parameter to a monitoring system, and comparing the first parameter to a first threshold value and comparing the second parameter to a second threshold value with the monitoring system.

In accordance with another aspect of the disclosure, a system includes a top drive movement measurement system having a sensor module configured to be disposed about and couple to a component of a top drive system and a monitoring system. The sensor module includes a first plurality of sensors, wherein the first plurality of sensors is configured to detect lateral movement of the component of the top drive system and a second plurality of sensors, wherein the second plurality of sensors is configured to detect one or more compression or tension forces in the component of the top drive system. The monitoring system includes a signal receiver configured to receive data from the sensor module, a processor, and one or more non-transitory, computer-readable media having executable instructions stored thereon, the executable instructions comprising instructions adapted to actuate an alert of the monitoring system when the first plurality of sensors detect lateral movement that exceeds a first threshold, the second plurality of sensors detect compression or tension that exceeds a second threshold, or both, and wherein the one or more non-transitory, computer-readable media comprises at least one value stored thereon, wherein the at least one value corresponds to the first threshold, the second threshold, or both.

DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide a swirl measurement system for a top drive system. As discussed in detail below, during a drilling or tubular (e.g., casing) running operation, a top drive system may rotate a tubular or string of tubular while the tubular is lowered into a wellbore. It is now recognized that, during these operations, the top drive system and/or tubular may become off balance and may move or sway from side to side in an oblong or circular motion. To improve monitoring and performance of top drive operations, the swirl measurement system is configured to measure and monitor linear, radial, lateral, and/or circular motion (e.g., swirl) of the top drive and a tubular supported by the top drive during a drilling or tubular running operation. For example, the swirl measurement system may include a sensor module having a linear accelerometer, a gyroscope, strain gauges, or any combination thereof, configured to collect data indicative of linear and/or circular motion (e.g., swirl) of the top drive and the tubular about a longitudinal axis. The swirl measurement system may also include a monitoring station or other monitoring system configured to analyze the collected data and/or alert a user or operator if the linear and/or circular motion (e.g., swirl) of the top drive and the tubular exceeds a threshold.

Figure 1:
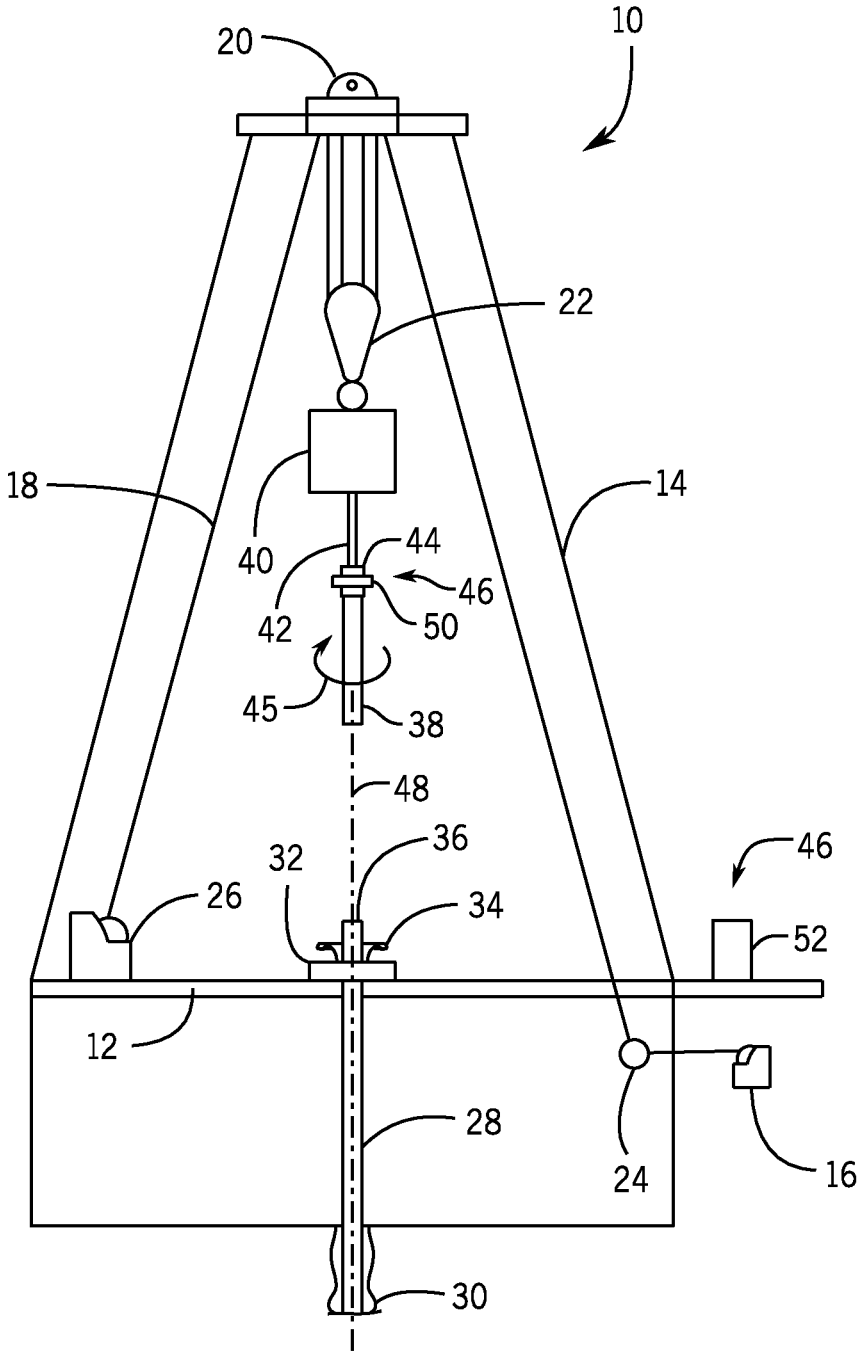
FIG. 1 is a schematic of a well being drilled, in accordance with present techniques.

Turning now to the drawings, FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a casing string 28 extends downward into a wellbore 30 and is held stationary with respect to the rig floor 12 by a rotary table 32 and slips 34. A portion of the casing string 28 extends above the rig floor 12, forming a stump 36 to which another length of tubular 38 (e.g., casing) may be added. In certain embodiments, the tubular 38 may include 30 foot segments of oilfield pipe having a suitable diameter (e.g., 13 ⅜ inches) that are joined as the casing string 28 is lowered into the wellbore 30. As will be appreciated, in other embodiments, the length and/or diameter of segments of the casing 16 (e.g., tubular 38) may be other lengths and/or diameters. The casing string 28 is configured to isolate and/or protect the wellbore 30 from the surrounding subterranean environment. For example, the casing string 28 may isolate the interior of the wellbore 30 from fresh water, salt water, or other minerals surrounding the wellbore 30.

When a new length of tubular 38 is added to the casing string 28, a top drive 40, hoisted by the traveling block 22, positions the tubular 38 above the wellbore 30 before coupling with the casing string 28. The top drive 40, once coupled with the tubular 38, may then lower the coupled tubular 38 toward the stump 36 such that the tubular 38 connects with the stump 36 and becomes part of the drill string 28. As the tubular 38 is lowered, the top drive 40 may rotate the tubular 38, as indicated by arrow 45. Specifically, the top drive 40 includes a quill 42 used to turn the tubular 38 and a saver sub 44 (e.g., a crossover sub) that couples the tubular 38 to the quill 42. In certain embodiments, the saver sub 44 (e.g., crossover sub) may include threads on both axial ends to couple the tubular 38 to the quill 42. Furthermore, the drilling rig 10 and the top drive 40 may also include a rotary table, a Kelly system, and/or other components or systems.

FIG. 1 further illustrates the top drive 40 with a swirl measurement system 46. As mentioned above, the top drive 40 may become off balance and may move or sway from side to side (e.g., linearly), in an oblong motion, and/or a circular motion during drilling or running of the casing string 28 and the tubular 38. When the top drive 40 moves or sways, the tubular 38 hoisted and supported by the top drive 40 may not remain centered over the stump 36 and the wellbore 30. Therefore, it may be desirable to measure and monitor any deviation of the top drive 40, quill 42, saver sub 44, and/or tubular 38 from a central axis 48 of the casing string 28 and stump 36 or other vertical axis. In other words, it may be desirable to measure and monitor movement (e.g., linear, oblong, circular, and/or swirl movement) of the top drive 40, quill 42, saver sub 44, and/or tubular 38 outside of or relative to an axis (e.g., the central axis 48).

Accordingly, in the illustrated embodiment, the top drive 40 includes the swirl measurement system 46, which is configured to measure and monitor movement of the top drive 40, quill 42, saver sub 44 (e.g., crossover sub), and/or tubular 38. In the illustrated embodiment, the swirl measurement system 46 includes a sensor module 50 and a monitoring station 52. The sensor module 50 is coupled to and disposed about the saver sub 44 (e.g., crossover sub). However, in other embodiments, the sensor module 50 may be coupled to the top drive 40, the quill 42, or another component of the drilling rig 10 associated with the top drive 40. As described in detail below, the sensor module 50 may include sensors, such as a linear accelerometer, a gyroscope, and/or strain gauges configured to collect data indicative of linear and/or circular motion (e.g., swirl) of the top drive 40, the quill 42, the saver sub 44, and/or and the tubular 38. Additionally, the sensor module 50 may include a signal transmitter (e.g., an antenna) or other communications device configured to communicate with a corresponding communications device of the monitoring station 52. Accordingly, the monitoring station 52 may receive and analyze data collected by the sensors of the sensor module 50. In certain embodiments, the monitoring station 52 may be configured to alert a user or operator when movement detected by the sensor module 50 exceeds a predetermined threshold.

It should be noted that the illustration of FIG. 1 is intentionally simplified to focus on the swirl measurement system 46 described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
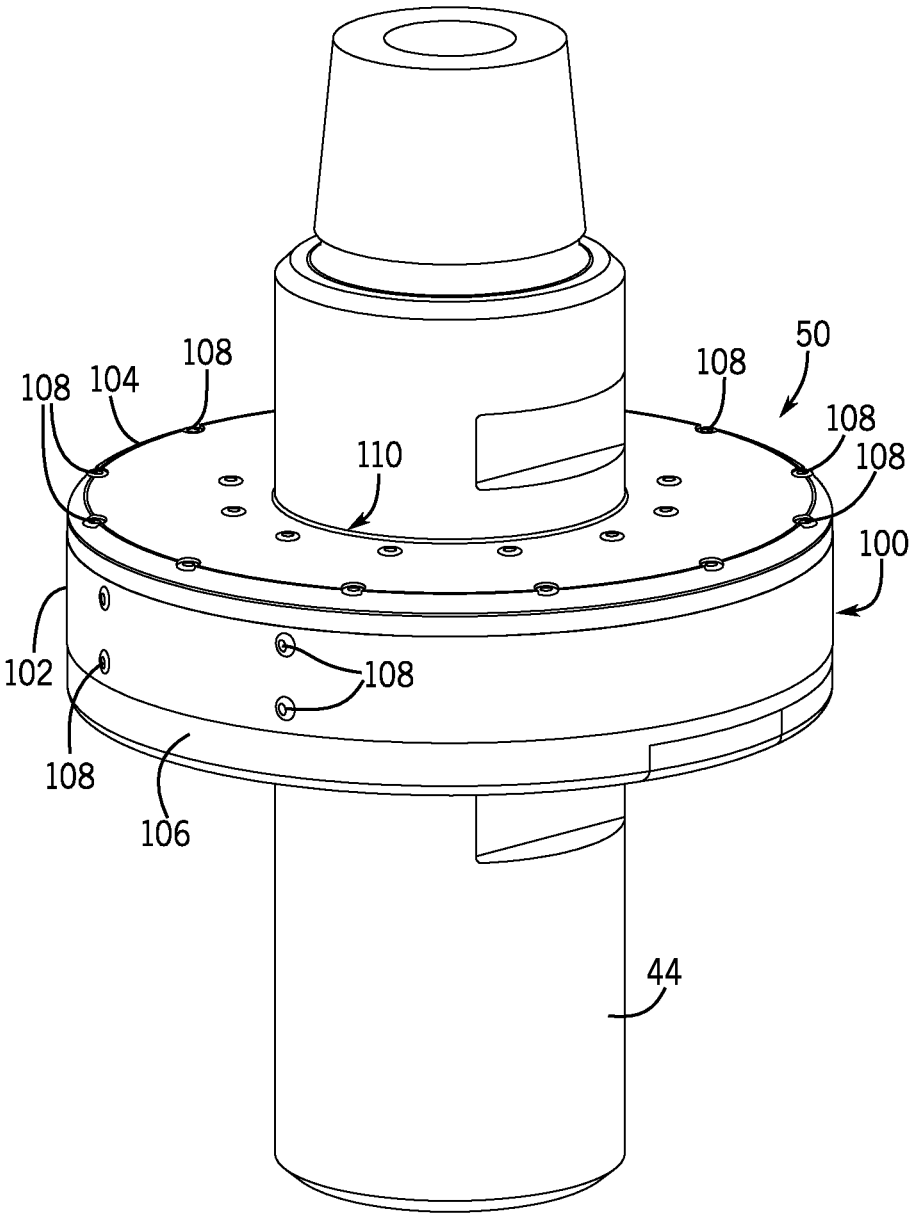
FIG. 2 is a perspective view of a saver sub having a swirl measurement system, in accordance with present techniques.

FIG. 2 is a perspective view of the saver sub 44 with the sensor module 50 of the swirl measurement system 46 disposed about and coupled to the saver sub 44 (e.g., crossover sub). In certain embodiments, the sensor module 50 may be coupled to the saver sub 44 by fasteners (e.g., bolts or screws), welding, brazing, a friction fit, an interference fit, or other coupling method. The sensor module 50 includes a housing 100 configured to house the various components of the sensor module 50, such as sensors, signal transmitters, printed circuit boards, etc. Specifically, the housing 100 includes a main body 102, a top cover 104, and a bottom cover 106. The housing 100 components (e.g., main body 102, top cover 104, and bottom cover 106) may be made from steel, aluminum, a plastic, or other durable material suitable for use in a drilling environment. Additionally, the housing 100 components (e.g., main body 102, top cover 104, and bottom cover 106) may be coupled to one another by fasteners 108 or by another method, such as retaining clips or threads. In other embodiments, the housing 100 may include other numbers of covers, such as 1, 2, 3, 4, 5, 6, or more covers to cover the various components within the housing 100.

In the illustrated embodiment, the housing 100 has an annular or donut-shaped configuration. As such, the housing 100 has a central aperture 110 through which the saver sub 44 is disposed. As the housing 100 is disposed about the saver sub 44, radial movement (e.g., linear, oblong, or swirl movement) of the saver sub 44 or other component coupled to the saver sub 44, such as the top drive 40, quill 42, or tubular 38, may be transferred to the housing 100 of the sensor module 50. Therefore, the sensors within the housing 100, which are described in further detail below, may detect radial movement (e.g., linear, oblong, or swirl movement about a longitudinal axis) of the saver sub 44, the top drive 40, the quill 42, and/or the tubular 38. As the sensors within the housing 100 detect radial movement of one or more of these components, a signal transmitter disposed within the housing 100 may transmit the measurements (e.g., in real time) to monitoring station 52 of the swirl measurement system 44. In this manner, radial movement (e.g., linear, oblong, or swirl movement) of the saver sub 44, the top drive 40, the quill 42, and/or the tubular 38 may be monitored during a drilling or tubular running process.

Figure 3:
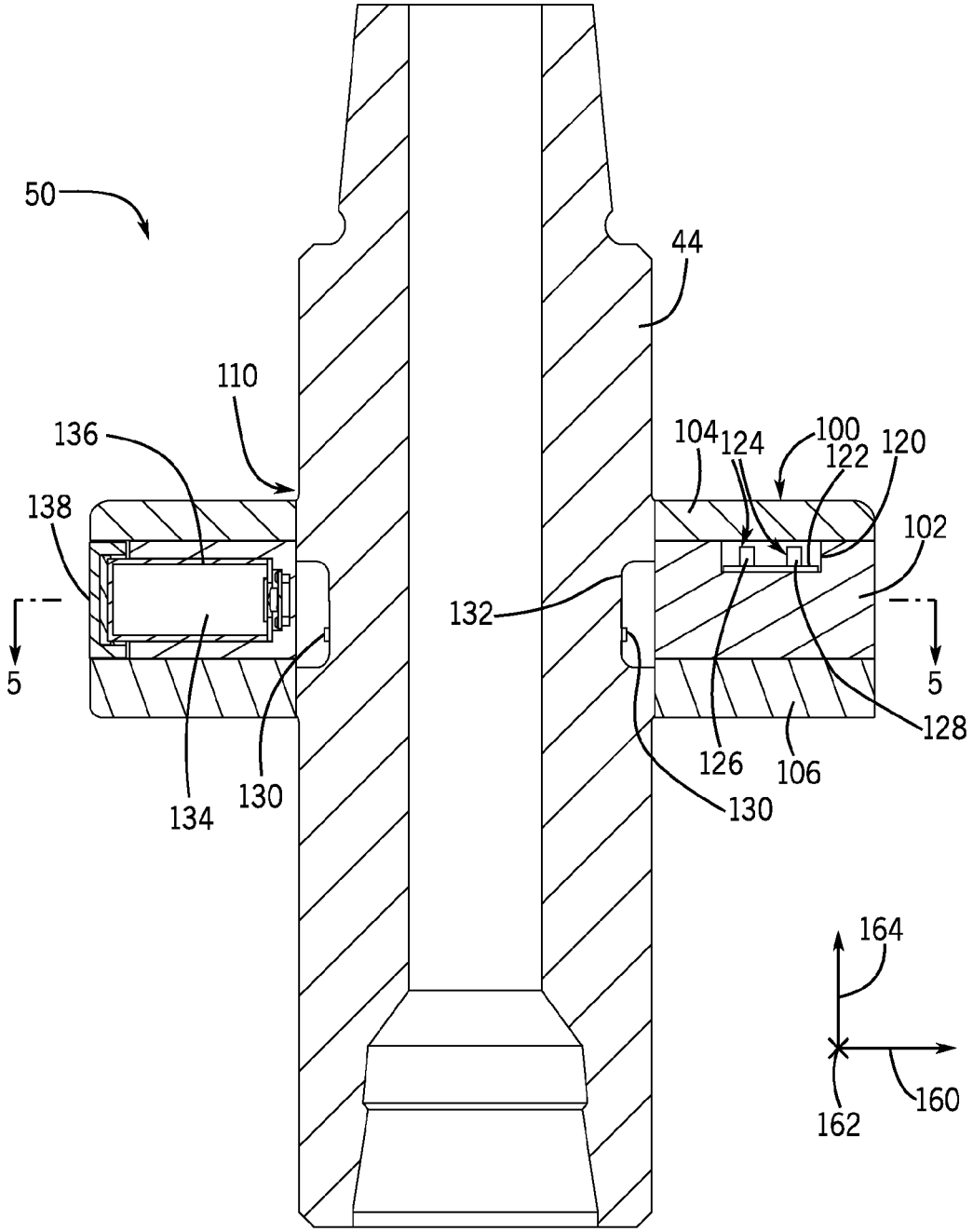
FIG. 3 is a cross-sectional side view of the saver sub having the swirl measurement system, in accordance with present techniques.

FIG. 3 is a cross-sectional view of the sensor module 50 disposed about the saver sub 44 of the top drive system 40. As mentioned above, the housing 100 encases various internal components of the sensor module 50. For example, in the illustrated embodiment, the main body 102 of the housing 100 includes a pocket or recess 120 that contains a printed circuit board 122 of the sensor module 50. Additionally, two sensors 124 are positioned on the printed circuit board 122 within the recess 120. Specifically, the sensor module 50 includes a linear accelerometer 126 and a gyroscope 128. In other embodiments, additional sensors 124 may be included as part of the sensor module 50, such as additional accelerometers, gyroscopes, magnetometers, compasses (e.g., a digital compass) or other types of sensors. As will be appreciated, the linear accelerometer 126 and the gyroscope 128 may be configured to measure acceleration, rotation, angular velocity, vibration, inertia, or other parameters indicative of movement.

For example, during rotation of the saver sub 44 (e.g., during running of the tubular 38), the linear accelerometer 126 may experience and detect constant forces in along an X-axis 160 and a Y-axis 162 of the saver sub 44. However, if the saver sub 44 is experiencing a swirl motion (e.g., oblong motion about a Z-axis 164 of the saver sub 44), the linear accelerometer 126 may detect increases and/or decrease in the forces acting along the X-axis 160 and Y-axis 162. Similarly, the gyroscope 128 may detect non-constant forces along the X-axis 160 and Y-axis 162 during swirl movement of the saver sub 44. The measurements obtained by the linear accelerometer 126 and the gyroscope 128 may be transmitted to the monitoring station 52 of the swirl measurement system 46 for analysis and monitoring. In certain embodiments, the monitoring station 52 may be configured to generate and display graphs using the measurements obtained by the linear accelerometer 126 and the gyroscope 128. In this manner, the measurements obtained by the sensors 124, and therefore swirl movement of the saver sub 44, may be monitored by an operator or user. Examples of such graphs are discussed below with respect to FIGS. 7 and 8.

Furthermore, the illustrated embodiment of the sensor module 50 and saver sub 44 includes strain gauges 130 disposed on an outside circumference 132 of the saver sub 44. In particular, a plurality of strain gauges 130 is positioned circumferentially (e.g., equidistantly or substantially equidistantly) about the outside circumference 132 of the saver sub 44. For example, 1, 2, 3, 4, 5, 6, 7, 8, 9, 10, or more strain gauges 130 may be positioned (e.g., circumferentially) on the outer circumference 132 of the saver sub 44. In other embodiments, the strain gauges 130 may be spaced or arranged in other configurations. The strain gauges 130 may further be operatively coupled to the printed circuit board 122. As will be appreciated, the strain gauges 130 are configured to measure strain (e.g., tension and compression forces) acting on the saver sub 44. For example, the strain gauges 130 may be flexible, adhesive sensors that include a metallic foil pattern configured to deform and change in electrical resistance when a force tension or compression force is applied to the surface of the saver sub 44. During movement (e.g., linear, oblong, or swirl movement) of the saver sub 44, one or more of the strain gauges 130 may detect strain (e.g., compression or tension) acting on one or more surfaces of the saver sub 44. The measurements obtained by the strain gauges 130 are described in further detail below. As with the measurements of the linear accelerometer 126 and the gyroscope 128, the measurements obtained by the strain gauges 130 may also be transmitted to the monitoring station 52 for analysis and monitoring.

The sensor module 50 may house other components as well. For example, in the illustrated embodiment, the housing 100 of the sensor module 50 houses a battery 134 within a pocket 136 (e.g., a recess) of the main body 102 of the housing 100. As shown, the pocket 136 includes a pocket cover 138 configured to seal the pocket 136 from the environment surrounding the sensor module 50. As will be appreciated, the pocket cover 138 may be removable to enable access to the battery 134 (e.g., for replacement) without removing the sensor module 50 from the saver sub 44 and/or disassembling other components of the sensor module 50.

The battery 134 is configured to supply power to one or more components of the sensor module 50, such as the printed circuit board 122, the linear accelerometer 126, the gyroscope 128, the strain gauges 130, communications components configured to transmit measured data to the monitoring station 52, or other components. The communications components of the sensor module 50 are discussed in further detail below with reference to FIG. 4.

Figure 4:
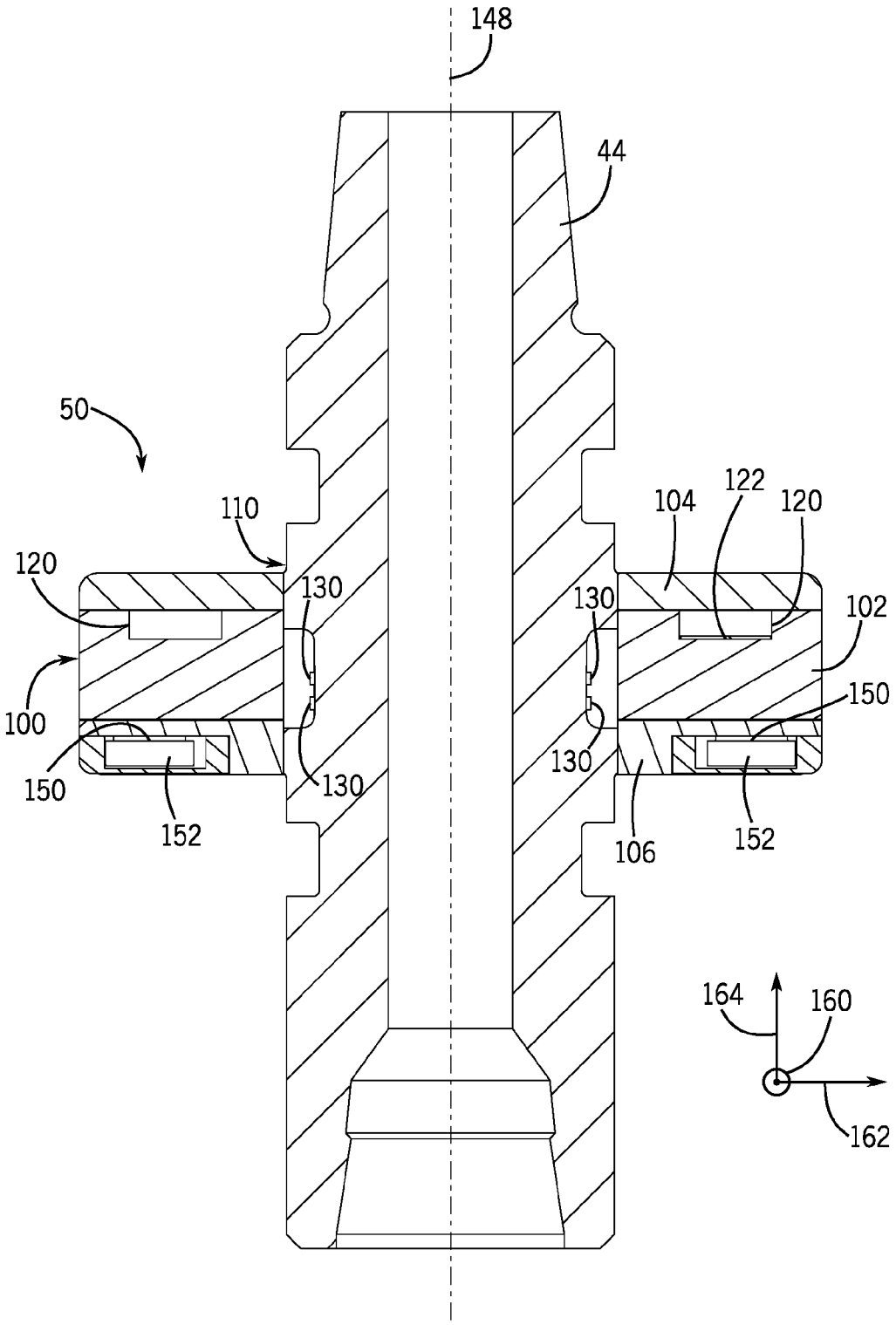
FIG. 4 is a cross-sectional side view of the saver sub having the swirl measurement system, in accordance with present techniques.

FIG. 4 is a cross-sectional view of the sensor module 50 disposed about the saver sub 44 of the top drive system 40. Specifically, the cross-sectional view in the illustrated embodiment illustrates the saver sub 44 and sensor module 50 rotated ninety degrees about a longitudinal axis 148 of the saver sub 44 relative to the cross-sectional view shown in FIG. 3. As mentioned above, the saver sub 44 may include communications components configured to transmit data measured by the sensors 124 (e.g., linear accelerometer 126, gyroscope 128, and/or strain gauges 130) to the monitoring station 52. For example, in the illustrated embodiment, the bottom cover 106 includes antenna pockets 150 configured to house antennas 152 (e.g., signal transmitters) of the sensor module 50. In certain embodiments, the antennas 152 may be configured to transmit data (e.g., measurement data from the sensors 124) as radio signals to a signal receiver of the monitoring system 52.

Figure 5:
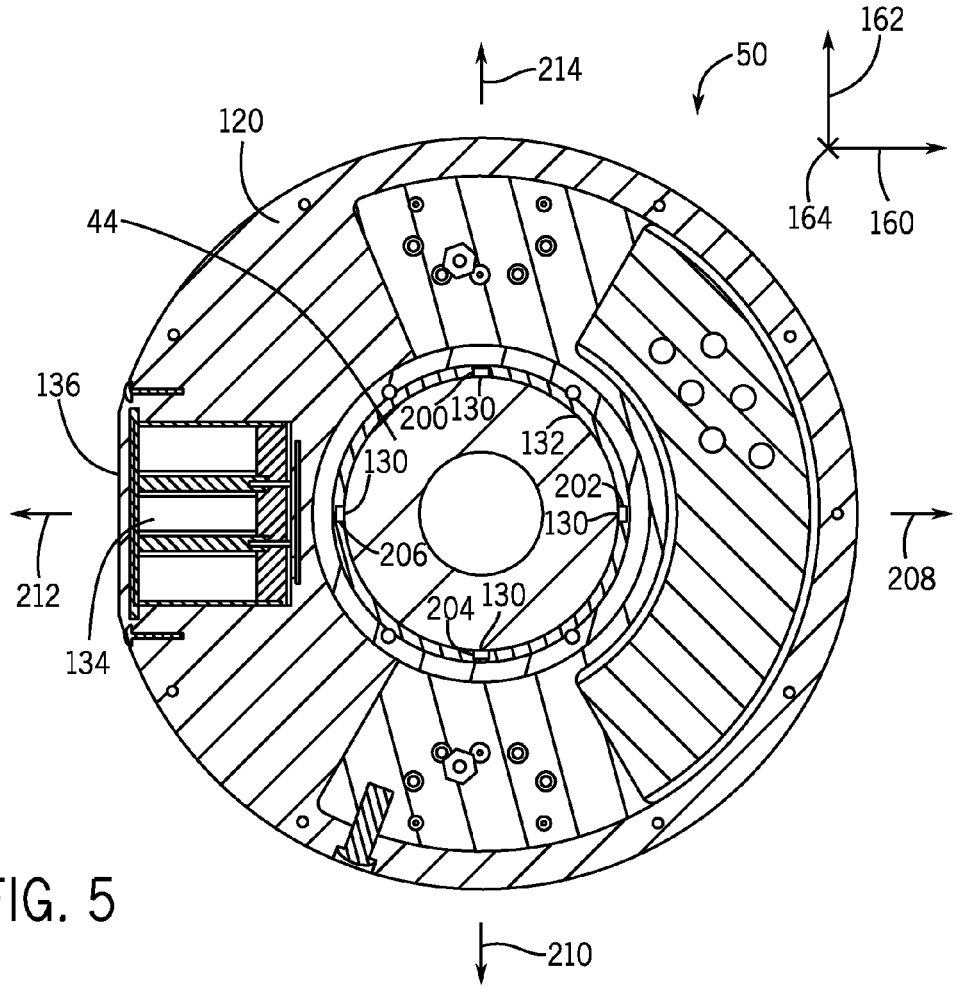
FIG. 5 is a cross-sectional axial view of the saver sub having the swirl measurement system, in accordance with present techniques.

FIG. 5 is a cross-sectional top view of the sensor module 50 and the saver sub 44, taken along line 5-5 of FIG. 3, illustrating an arrangement of strain gauges 130 about the outer circumference 132 of the saver sub 44. Specifically, the illustrated embodiment includes four strain gauges 130 (e.g., a first strain gauge 200, a second strain gauge 202, a third strain gauge 204, and a fourth strain gauge 206) disposed about the outer circumference 132 of the saver sub 44 approximately ninety degrees from one another. However, in other embodiments, the saver sub 44 may have other numbers of strain gauges 130 positioned on the outer circumference 132. Additionally, in certain embodiments, more than one strain gauge 130 may be positioned at a particular location about the outer circumference 132 of the saver sub 44. As mentioned above, the strain gauges 130 are configured to measure strain (e.g., tension and compression forces) acting on the surface of the saver sub 44. In particular, the strain gauges 130 may measure a moving bending moment acting on the saver sub 44.

During a swirl motion of the saver sub 44 (e.g., circular movement about the Z-axis 164 of the saver sub 44) one or two strain gauges 130 may detect a compression force on the outer circumference 132 of the saver sub 44 and one or two strain gauges 130 may detect a tension force on the outer circumference 132 of the saver sub 44. The following discussion describes measurements of the strain gauges 130 in the illustrated embodiment during clockwise circular swirl of the saver sub 44. For example, if the saver sub 44 is bending or moving in a direction 208 (and therefore bowing in a direction opposite direction 208) during clockwise circular swirl movement, the second strain gauge 202 may detect a compressive force, and the fourth strain gauge 206 may detect a tension force. Thereafter, as the saver sub 44 continues to swirl clockwise, the saver sub 44 will bend in a direction 210. When the saver sub 44 bends in the direction 210, the third strain gauge 204 will detect a compressive force, and the first strain gauge 200 will detect a tension force. As the saver sub 44 continues to swirl clockwise, the saver sub 44 will bend in a direction 212. When the saver sub 44 bends in the direction 212, the fourth strain gauge 206 will detect a compressive force, and the second strain gauge 202 will detect a tension force. Lastly, when the saver sub 44 bends in the direction 214, the first strain gauge 200 will detect a compressive force, and the third strain gauge 204 will detect a tension force. In other words, when the saver sub 44 is bending in a particular direction during a swirl movement, at least one strain gauge 130 will experience a compressive force, and another strain gauge on the opposite side of the saver sub 44 will experience a tension force.

As will be appreciated, at certain positions of the saver sub 44 during the clockwise, circular swirl movement, two strain gauges 130 may detect a compression force on the outer circumference 132 and two strain gauges 130 may detect a tension force. For example, as the saver sub 44 swirls from bending in the direction 208 to the direction 210, the second and third strain gauges 202 and 204 may detect a compressive force and the first and fourth strain gauges 200 and 206 may experience a tension force. As similarly described above, the monitoring station 52 may be configured to generate and display graphs using the measurements obtained by strain gauges 130. In this manner, the measurements obtained by the sensors 124, and therefore swirl movement of the saver sub 44, may be monitored by an operator or user. Examples of such graphs are described below with respect to FIGS. 9 and 10.

Figure 6:
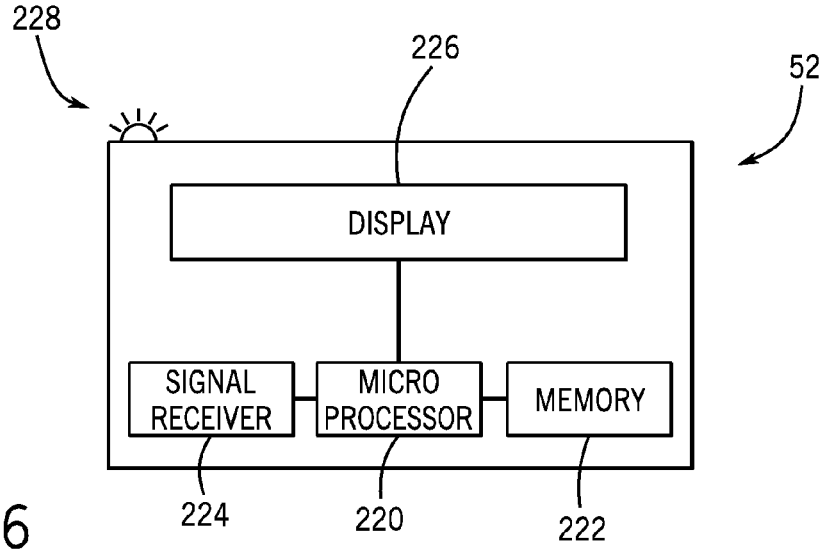
FIG. 6 is a schematic of a monitoring station of the swirl measurement system, in accordance with present techniques.

FIG. 6 is a schematic representation of the monitoring system 52 of the swirl measurement system 46. The monitoring system 52 includes one or more microprocessors 220, a memory 222, a signal receiver 224, and a display 226 (e.g., an LCD). The memory 222 is a non-transitory (not merely a signal), computer-readable media, which may include executable instructions that may be executed by the microprocessor 220. Additionally, the memory 222 may be configured to store data collected by the swirl measurement system 46. For example, the signal receiver 224 may receive data measurements from the sensor module 50. These data measurements may include measurements detected by the linear accelerometer 126, the gyroscope 128, the strain gauges 130, and/or other data. Using the collected data, the microprocessor 220 may generate a graphical output of the forces measured by the linear accelerometer 126, the gyroscope 128, and/or the strain gauges 130. The graphical output may then be displayed on the display 226 for viewing and monitoring by an operator or user. In other embodiments, the microprocessor 220 may generate a different or additional output. For example, the output of the microprocessor 220 may be a normalized displacement value (e.g., a number) that represents an amount of lateral movement, swirl, or other movement of the sensor module 50, and thus, the saver sub 44. In such embodiments, the normalized displacement value may be numerically displayed on the display 226, may be represented graphically (e.g., by a bar graph), or may be displayed by the display 226 in another suitable manner.

In certain embodiments, threshold measurement values (e.g., forces detected by the sensors 124, normalized displacement threshold value, etc.) may be stored in the memory 222. For example, the threshold measurement values may correlate to an amount or level of movement (e.g., swirl) for which an operator may wish to power down the top drive 40. If the measured values meet or exceed the threshold values, an alarm 228, such as an auditory and/or visual alarm, of monitoring system 52 may be activated to alert a user or operator that the swirl movement has exceeded the threshold. In some embodiments, the monitoring system 52 may automatically assert control and make adjustments (e.g., slow or shutdown operation of the top drive 40) when certain measurement values are observed.

Figure 7:
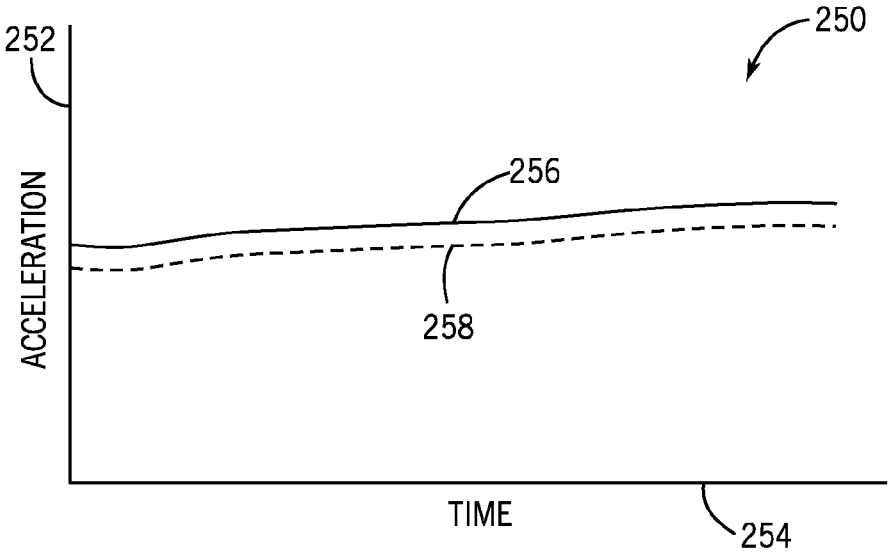
FIG. 7 is a graph illustrating linear acceleration measurements of an accelerometer of the swirl measurement system versus time, in accordance with present techniques.
Figure 8:
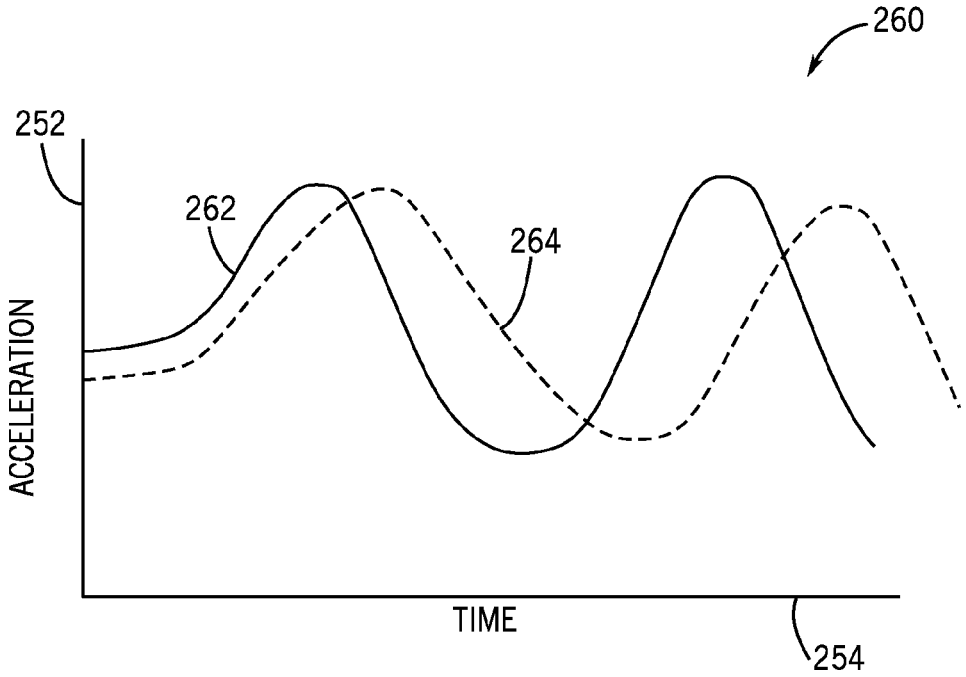
FIG. 8 is a graph illustrating linear acceleration measurements of an accelerometer of the swirl measurement system versus time, in accordance with present techniques.

FIGS. 7-10 illustrate embodiments of graphs that may be generated and/or displayed by the monitoring system 52. For example, FIGS. 7 and 8 are graphs illustrating data that may be collected by the linear accelerometer 126. In FIG. 7, a graph 250 illustrates acceleration 252 data with respect to time 254. In particular, a first line 256 may represent acceleration 252 or force measured by the linear accelerometer 126 along the X-axis 160, and a second line 258 may represent acceleration 252 or force measured by the accelerometer 126 along the Y-axis 162. As shown in the graph 250, the accelerations 252 along the X-axis 160 and Y-axis 162 remain essentially constant. For example, the accelerations 252 may be approximately zero. However, as will be appreciated, the measured accelerations 252 may not be exactly constant as the linear accelerometer 126 may also detect variances (e.g., minor variances) in acceleration 252. Nevertheless, when the accelerations 252 measured by the linear accelerometer 126 are constant or substantially constant, the saver sub 44 may not be experiencing swirl, or swirl experienced by the saver sub 44 may be completely centralized and circular.

In FIG. 8, a graph 260 also illustrates acceleration 252 data with respect to time 254. In the illustrated embodiment, the data depicted by the graph 260 indicated that the saver sub 44 may be experiencing an oblong swirl movement. That is, the linear forces detected by the liner accelerometer 126 along the X-axis 160 and Y-axis 162 vary. For example, a first line 262 may represent acceleration 252 or force measured by the linear accelerometer 126 along the X-axis 160, and a second line 264 may represent acceleration 252 or force measured by the accelerometer 126 along the Y-axis 162. As shown, the lines 262 and 264 have peaks and troughs, indicating that the saver sub 44 is experiencing swirl movement (e.g., oblong swirl movement). As will be appreciated, a graph illustrating data measured by the gyroscope 128 during swirl movement of the saver sub 44 may be similar to the data illustrated in graph 260.

Figure 9:
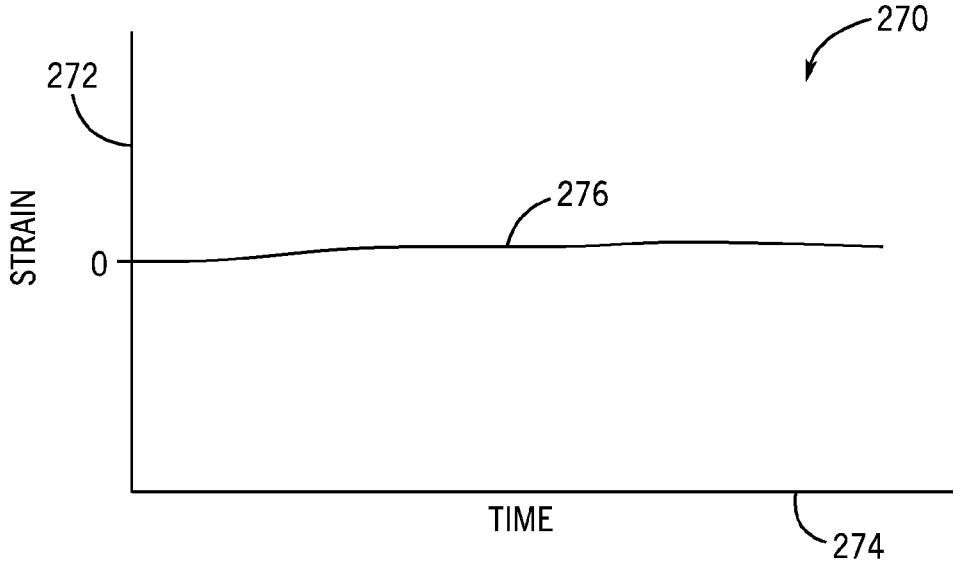
FIG. 9 is a graph illustrating measurements of strain gauges of the swirl measurement system versus time, in accordance with present techniques.
Figure 10:
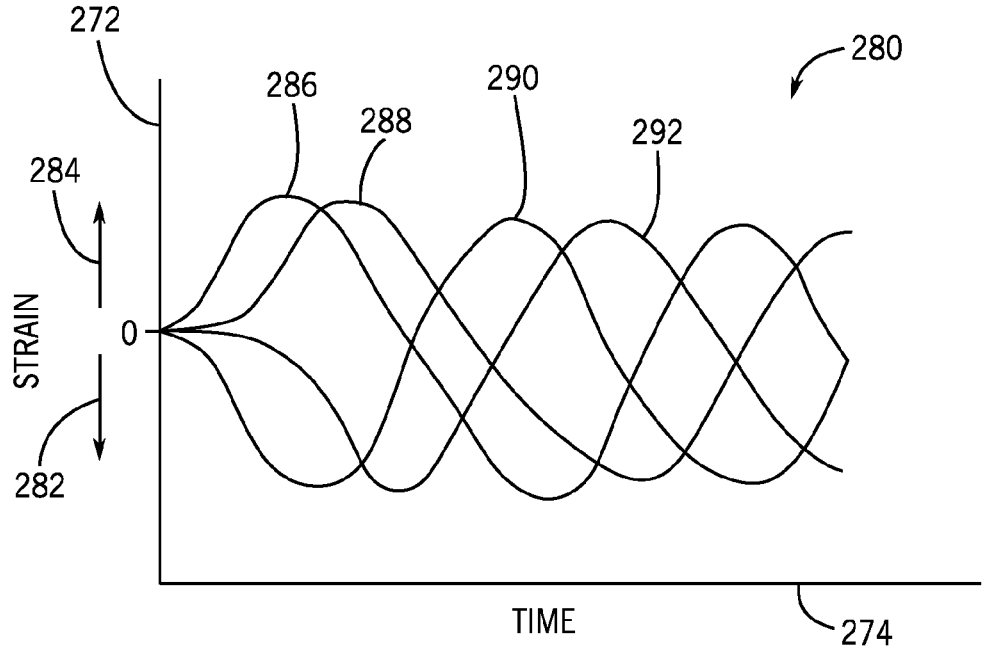
FIG. 10 is a graph illustrating measurements of strain gauges of the swirl measurement system versus time, in accordance with present techniques.

FIGS. 9 and 10 are graphs illustrating data that may be collected by the strain gauges 130. For example, FIG. 9 shows a graph 270 displaying data measured by the strain gauges 130 when the saver sub 44 is not experiencing swirl movement. Specifically, the graph 270 plots strain 272 (e.g., compressive or tension force) measurements of the strain gauges 130 with respect to time 274. As will be appreciated, when the saver sub 44 is rotating during running of the tubular 38 but not experiencing swirl movement about the longitudinal axis 148 of the saver sub 44, the saver sub 44 may not experience any bending (e.g., compressive or tension forces). As such, a line 276 in graph 270 shows that none of the strain gauges 130 are detecting any compressive or tension forces.

FIG. 10 shows a graph 280 displaying data measured by the strain gauges 130 when the saver sub 44 is experiencing swirl movement (e.g., circular swirl movement) about the longitudinal axis 148 of the saver sub 44. As similarly described above with respect to FIG. 9, the graph 280 plots strain 272 with respect to time 274. The strain 272 measured by the strain gauges 130 may be compressive forces 282 or tension forces 284. In the illustrated embodiment, the graph 280 shows data collected by the strain gauges 130 when the saver sub 44 is experiencing circular, swirl movement.

As described above, during swirl movement of the saver sub 44, one or two strain gauges 130 may detect a compression force on the outer circumference 132 of the saver sub 44 and one or two strain gauges 130 may detect a tension force on the outer circumference 132 of the saver sub 44. For example, line 286 in graph 280 may represent data collected from the first strain gauge 200 shown in FIG. 5, line 288 may represent data collected from the second strain gauge 202 shown in FIG. 5, line 290 may represent data collected from the third strain gauge 204 shown in FIG. 5, and line 292 may represent data collected from the fourth strain gauge 206 shown in FIG. 5. As described in detail above, during swirl movement of the saver sub 44, when the first strain gauge 200 detects tension force 284 on the saver sub 44, the third strain gauge 204 detects compressive force 282 on the saver sub 44 (e.g., when the saver sub 44 is bending in the direction 210). As the saver sub 44 continues to swirl about the longitudinal axis 148 (e.g., in a clockwise direction), the saver sub 44 bends in the direction 212, thereby causing the second strain gauge 202 to detect tension force 284 and the fourth strain gauge 206 to detect compressive force 282, and so forth.

As discussed in detail above, present embodiments provide the swirl measurement system 46 for the top drive system 40. As discussed above, during a drilling or tubular 38 (e.g., casing 28) running operation, the top drive system 40 rotates the tubular 38 while the tubular 38 is lowered into the wellbore 30. To improve monitoring and performance of top drive 40 operations, the drilling rig 10 may include the swirl measurement system 46, which is configured to measure and monitor linear and/or circular motion (e.g., swirl) of the top drive 40 and the tubular 38 supported by the top drive 40 during the drilling or tubular 38 running operation. For example, the swirl measurement system 46 may include the sensor module 50 having the linear accelerometer 126, the gyroscope 128, the strain gauges 130, or any combination thereof, configured to collect data indicative of linear and/or circular motion (e.g., swirl) of the top drive 40 and the tubular 38 about a longitudinal axis (e.g., longitudinal axis 148). The embodiments discussed above describe the sensor module 50 coupled to the saver sub 44 of the top drive system 30. However, in other embodiments, the sensor module 50 may be coupled to or integral with another component of the top drive system 40 or drilling rig 10. Furthermore, while the above embodiments of the sensor module 50 are described as including the linear accelerometer 126, the gyroscope 128, and the strain gauges 130, other embodiments of the sensor module 50 may include the linear accelerometer 126, the gyroscope 128, or the strain gauges 130 alone or in any other combination. The swirl measurement system 46 may also include the monitoring system 52 configured to analyze the collected data, display the collected data, and/or alert a user or operator if the linear and/or circular motion (e.g., swirl) of the top drive 40 and the tubular 38 exceeds a threshold.

While only certain features of present embodiments have been illustrated and described herein, many modifications and changes will occur to those skilled in the art. It is, therefore, to be understood that the appended claims are intended to cover all such modifications and changes as fall within the true spirit of the invention.

The invention claimed is:

1. A top drive system; comprising:

a top drive movement measurement system, comprising:

a saver sub configured to couple to the top drive system;

an annular housing disposed about the saver sub;

a first plurality of sensors disposed within the annular housing, wherein the first plurality of sensors is configured to detect lateral movement of the saver sub of the top drive system, wherein the first plurality of sensors comprises a linear accelerometer and a gyroscope;

a second plurality of sensors disposed about an outer circumference of the saver sub, wherein the second plurality of sensors is configured to detect one or more compression or tension forces on the saver sub of the top drive system, wherein the second plurality of sensors comprises a plurality of strain gauges, wherein the plurality of strain gauges are spaced equidistantly about the outer circumference of the saver sub; and one or more non-transitory, computer-readable media having executable instructions stored thereon, the executable instructions comprising instructions configured to detect circular or oblong movement of the saver sub of the top drive system based on combined data collected by the first plurality of sensors, the second plurality of sensors, or both, and instructions configured to generate an alert upon detection of the circular or oblong movement, wherein the detection of the circular or the oblong movement comprises the first plurality of sensors detecting lateral movement that exceeds a first threshold and the second plurality of sensors detecting compression and tension forces that exceed a second threshold, wherein the one or more non-transitory, computer-readable media comprises at least one first value and at least one second value stored thereon, wherein the at least one first value corresponds to the first threshold value and the at least one second value corresponds to the second threshold value.

2. The system of claim 1, wherein the annular housing comprises at least one cover, wherein the first plurality of sensors are coupled to a printed circuit board disposed in the annular housing.

3. The system of claim 2, wherein a battery is disposed within the annular housing, wherein the battery is configured to supply power to the first plurality of sensors, second plurality of sensors, the printed circuit board, or any combination thereof.

4. The system of claim 1, wherein the annular housing comprises an antenna, wherein the antenna is configured to transmit the combined data collected by the first plurality of sensors, the second plurality of sensors, or both to a monitoring system of the top drive movement measurement system.

5. The system of claim 4, wherein the top drive movement measurement system comprises the monitoring system, wherein the monitoring system comprises:

a signal receiver configured to receive the combined data from the antenna;

a processor; and the one or more non-transitory, computer-readable media having executable instructions stored thereon.

6. A method, comprising:

operating a top drive system of a drilling rig;

detecting a first parameter indicative of lateral movement of the top drive system with respect to a rotational axis of the top drive system with one or more accelerometers, one or more gyroscopes, or a combination of both;

detecting a second parameter indicative of lateral movement of the top drive system with respect to the longitudinal axis of the top drive system with one or more strain gauges, wherein the first parameter is different from the second parameter;

transmitting the first parameter and the second parameter to a monitoring system;

comparing the first parameter to a first threshold value and comparing the second parameter to a second threshold value with the monitoring system;

detecting presence of circular or oblong movement in the top drive system based on the first parameter and the second parameter; and generating an alert with the top drive system when the first parameter exceeds the first threshold value, the second parameter exceeds the second threshold value, or both, wherein detecting the first parameter indicative of lateral movement of the top drive system with respect to the rotational axis of the top drive system with the one or more accelerometers, one or more gyroscopes, or a combination of both comprises detecting a first linear force in a first lateral direction and detecting a second linear force in a second lateral direction, wherein the first lateral direction is perpendicular to the second lateral direction, wherein detecting the second parameter indicative of lateral movement of the top drive system with respect to the longitudinal axis of the top drive system with the one or more strain gauges comprises detecting strain on a surface of a saver sub of the top drive system, and wherein detecting the second parameter indicative of lateral movement of the top drive system with respect to the longitudinal axis of the top drive system with the one or more strain gauges comprises detecting a compression measurement with a first strain gauge of the plurality of strain gauges and subsequently detecting a tension measurement with a second strain gauge of the plurality of strain gauges.

7. The method of claim 6, wherein detecting strain on the surface of the saver sub of the top drive system with the one or more strain gauges comprises detecting strain on an outer circumference of the saver sub of the top drive system.

8. The method of claim 6, comprising:

generating at least one output value of the first parameter, the second parameter, or both with respect to time; and displaying the at least one output value on a display.

9. A top drive movement measurement system comprising:

an annular housing configured to be disposed about and couple to a saver sub of a top drive system, wherein the annular housing comprises:

a first plurality of sensors disposed within the annular housing, wherein the first plurality of sensors is configured to detect lateral movement of the saver sub of the top drive system; and second plurality of sensors disposed about an outer circumference of the saver sub, wherein the second plurality of sensors is configured to detect one or more compression or tension forces on the saver sub of the top drive system, wherein the first plurality of sensors comprises a linear accelerometer, a gyroscope, or both, and the second plurality of sensors comprises a plurality of strain gauges; and a monitoring system, comprising:

a signal receiver configured to receive data from the first plurality of sensors, the second plurality of sensors, or both;

a processor; and one or more non-transitory, computer-readable media having executable instructions stored thereon, the executable instructions comprising instructions configured to actuate an alert of the monitoring system when the first plurality of sensors, the second plurality of sensors, or both provide combined data indicative of circular or oblong movement of the saver sub of the top drive system, wherein the alert comprises a visual alert, an auditory alert, or both, wherein the one or more non-transitory, computer-readable media is configured to detect the circular or the oblong movement when a first strain gauge of the plurality of strain gauges detects a compression measurement in excess of a first threshold value and a second strain gauge of the plurality of strain gauges subsequently detects a tension measurement in excess of a second threshold value, wherein the first and second strain gauges are coupled to the outer circumference of the saver sub of the top drive system, and the first and second strain gauge are disposed approximately 180 degrees apart from one another about the outer circumference of the saver sub, and wherein the one or more non-transitory, computer-readable media comprises at least one first value and at least one second value stored thereon, wherein the at least one first value corresponds to the first threshold value and the at least one second value corresponds to the second threshold value.

10. The system of claim 9, wherein the plurality of strain gauges are disposed equidistantly about the outer circumference of the saver sub.

11. The system of claim 9, wherein the monitoring system comprises a display, and wherein the executable instructions comprise instructions configured to generate at least one output value representative data and display the at least one output value on the display.

* * * * *